US009759232B2

(12) United States Patent
Hoemke

(10) Patent No.: US 9,759,232 B2
(45) Date of Patent: Sep. 12, 2017

(54) ROTARY ACTUATOR WITH INTEGRATED ACTUATION

(71) Applicant: Brian E. Hoemke, Belvidere, IL (US)

(72) Inventor: Brian E. Hoemke, Belvidere, IL (US)

(73) Assignee: Woodward, Inc., Fort Collins, CO (US)

( * ) Notice: Subject to any disclaimer, the term of this patent is extended or adjusted under 35 U.S.C. 154(b) by 652 days.

(21) Appl. No.: 14/192,302

(22) Filed: Feb. 27, 2014

(65) Prior Publication Data

US 2015/0240827 A1 Aug. 27, 2015

(51) Int. Cl.

| | |
|---|---|
| ***F15B 15/12*** | (2006.01) |
| ***F04D 29/56*** | (2006.01) |
| ***F15B 15/06*** | (2006.01) |
| ***F01D 17/26*** | (2006.01) |

(52) U.S. Cl.
CPC ..... *F04D 29/563* (2013.01); *F01D 17/26* (2013.01); *F15B 15/068* (2013.01); *F15B 15/12* (2013.01); *F15B 15/125* (2013.01)

(58) Field of Classification Search
CPC ..... F15B 15/12; F15B 15/125
See application file for complete search history.

(56) References Cited

U.S. PATENT DOCUMENTS

| | | | | |
|---|---|---|---|---|
| 2,801,068 | A * | 7/1957 | Deriaz | F03B 3/145 416/157 R |
| 3,367,424 | A * | 2/1968 | Fukasu | F03B 3/14 416/146 R |
| 3,731,546 | A | 5/1973 | Macdonald | |
| 4,755,104 | A | 7/1988 | Castro et al. | |
| 5,549,448 | A | 8/1996 | Langston | |
| 5,996,523 | A | 12/1999 | Fox | |
| 6,361,033 | B1 | 3/2002 | Jones et al. | |
| 6,769,868 | B2 | 8/2004 | Harrold | |
| 8,435,000 | B2 | 5/2013 | Wong et al. | |

FOREIGN PATENT DOCUMENTS

| | | |
|---|---|---|
| EP | 1 101 902 A2 | 5/2001 |
| EP | 2 644 823 A2 | 10/2013 |

* cited by examiner

*Primary Examiner* — Justin Seabe
(74) *Attorney, Agent, or Firm* — Reinhart Boerner Van Deuren P.C.

(57) ABSTRACT

A rotary actuator is provided. The rotary actuator includes a stator assembly centered along a longitudinal axis of the rotary actuator. The rotary actuator also includes a rotor assembly surrounding the stator assembly. The rotor assembly is rotatable about the longitudinal axis relative to the stator assembly. The rotary actuator also includes first and second bearing assemblies mounted at adjacent opposed axial ends of the stator assembly and connected between the stator assembly and rotor assembly to allow for the rotation of the rotor assembly about the longitudinal axis relative to the stator assembly. A hydraulic actuation arrangement is formed between the rotor assembly and the stator assembly. The hydraulic actuation arrangement includes at least one first pressure chamber and at least one second pressure chamber. At least one of the at least one first pressure chamber and the at least one second pressure chamber has a variable volume.

11 Claims, 14 Drawing Sheets

ROTARY ACTUATOR WITH INTEGRATED ACTUATION

FIELD OF THE INVENTION

This invention generally relates actuators typically employed in engine environments, and more particularly to turbine engines incorporating variable stator vanes, and even more particularly to actuators for variable stator vanes.

BACKGROUND OF THE INVENTION

Contemporary gas turbine engines incorporate an axial compressor section that is comprised of a plurality of airfoil sections, i.e. vanes, extending radially outwardly from a central axis of the gas turbine engine in a circular pattern, and rotatable about the central axis. Multiple circular patterns of rotor vanes are typically arranged sequentially in rows along the central axis. Between adjacent rows of rotor vanes there is also typically a set of vanes, also arranged in a circular pattern and extending radially relative to the central axis of the engine, differing from the rotor vanes in that these vanes do not rotate about the central axis of the turbine engine. These non-rotating vanes are commonly referred to as stator vanes, and each row thereof is commonly referred to as a stage. It is known to incorporate a plurality of rows of rotor vanes, as well as a plurality of rows of stator vanes, in an alternating pattern.

It is known to adjust the orientation of each stator vane about its central, radially extending, longitudinal axis to vary the angle of attack these stator vanes present to air flowing axially along the central axis of the engine and from the upstream rotating set of rotor vanes using an actuator. These variable stator vanes allow for the turbine engine to achieve air flow pressure characteristics for optimal operation in various modes of operation.

Various actuator configurations are known for achieving the aforementioned variable stator vane actuation. Each row of stator vanes, and particularly each vane thereof, is typically connected to a unison ring that is accessible from an exterior of a housing containing the rotor and stator vane rows. Rotation of this unison ring about the central axis of the engine results in the above described stator vane actuation. Each row of stator vanes has its own unison ring. A typical variable stator vane actuator thus manipulates multiple unison rings to govern the orientation of the variable stator vanes of each row of stator vanes. Examples of such actuators may be seen from inspection of U.S. Pat. Nos. 4,755,104, 5,549,448, 6,769,868, and 8,435,000, the entire teachings and disclosures of which are incorporated herein by reference thereto.

A common thread of such actuators, unfortunately, is that they are relatively complex in their construction, relatively large in size and weight, present a significant amount of wear points, and have high reactive loads. Indeed, U.S. Pat. No. 5,549,448 illustrates a conventional bell-crank style actuation arrangement. Such configurations are typically actuated by a linear actuator that is arranged and operates parallel to the central axis of the engine. This style is generally compact given the parallel arrangement of the linear actuator; however, it is also quite complex in its linkage arrangement as it requires multiple individual bell-crank mechanisms driven by a common master bell-crank mechanism, each of which presents a wear point and possible point of failure.

As another example, U.S. Pat. No. 8,435,000 illustrates a more contemporary torque-tube style actuation arrangement, wherein a rotary actuator, typically referred to as a torque tube, is arranged parallel to the central axis of the engine. A plurality of linkage arms extend from the torque tube and are connected respectively to each unison ring. An actuator acts upon the torque tube to rotate the same about its central axis to ultimately rotate the unison rings to achieve a desired stator vane orientation. This style is generally less complex than the bell-crank configuration described above. However, this configuration also utilizes a linear actuator that is arranged transverse to the central axis of the engine, and thus results in an undesirably large footprint within the engine space.

As such, there is a need in the art for a rotary actuator that has a reduced complexity, part count, number of wear points, and size.

The invention provides such a variable stator vane actuator. These and other advantages of the invention, as well as additional inventive features, will be apparent from the description of the invention provided herein.

BRIEF SUMMARY OF THE INVENTION

In one aspect, the invention provides a rotary actuator with a reduced overall space footprint for actuating the variable stator vanes of a compressor section of a turbine engine. An embodiment of the rotary actuator includes a stator assembly centered along a longitudinal axis of the rotary actuator. The rotary actuator also includes a rotor assembly surrounding the stator assembly. The rotor assembly is rotatable about the longitudinal axis relative to the stator assembly. The rotary actuator also includes first and second bearing assemblies mounted at adjacent opposed axial ends of the stator assembly and connected between the stator assembly and rotor assembly to allow for the rotation of the rotor assembly about the longitudinal axis relative to the stator assembly. A hydraulic actuation arrangement is formed between the rotor assembly and the stator assembly. The hydraulic actuation arrangement includes at least one first pressure chamber and at least one second pressure chamber. The at least one first pressure chamber is operable to receive a hydraulic fluid at a first pressure. The at least one second pressure chamber is operable to receive a hydraulic fluid at a second pressure different than the first pressure to create a pressure differential between the at least one first and second pressure chambers to rotate the rotor assembly about the longitudinal axis.

In another aspect, the invention provides a rotary actuator with a reduced parts count and complexity for actuating the variable stator vanes of a compressor section of a turbine engine. The rotary actuator includes a stator assembly centered along a longitudinal axis of the rotary actuator. The rotary actuator also includes a rotor assembly surrounding the stator assembly. The rotor assembly is rotatable about the longitudinal axis relative to the stator assembly. The rotary actuator also includes first and second bearing assemblies mounted at adjacent opposed axial ends of the stator assembly and connected between the stator assembly and rotor assembly to allow for the rotation of the rotor assembly about the longitudinal axis relative to the stator assembly. A hydraulic actuation arrangement is formed between the rotor assembly and the stator assembly. The hydraulic actuation arrangement includes at least one first pressure chamber and at least one second pressure chamber. At least one of the at least one first pressure chamber and the at least one second pressure chamber has a variable volume.

In certain embodiments according to the foregoing aspects, the rotary actuator includes an inlet manifold. The inlet manifold has a first inlet and a second inlet. The stator assembly includes an internal cavity defining a first inlet chamber and a second inlet chamber. The first inlet chamber is in fluid communication with the first inlet. The second inlet chamber is in fluid communication with the second inlet. An inlet tube extends from the first inlet and fluidly seals the first inlet chamber from the second inlet chamber. The first inlet chamber includes at least one inlet port fluidly communicating the first inlet with the least one first pressure chamber. The second inlet chamber includes at least one inlet port fluidly communicating the second inlet with the at least one second pressure chamber.

In certain embodiments according to the foregoing aspects, the hydraulic actuation arrangement includes at least one stator vane extending radially outward from a center of the stator assembly, and at least one rotor vane extending radially inward from an interior hollow surface of an outer housing of the rotor assembly. The at least one stator vane sealingly engages the interior surface of the rotor housing. The at least one rotor vane sealingly engages an exterior surface of the stator assembly. The at least one first pressure chamber is formed on a first side of the at least one stator vane. The at least one second pressure chamber is formed on a second side of the at least one stator vane.

In certain embodiments according to the foregoing aspects, the hydraulic actuation arrangement includes a core member defining the at least one second pressure chamber and wherein the at least one first pressure chamber is formed between an exterior surface of the core member, and an interior surface of an outer housing of the rotor assembly. The hydraulic actuation arrangement includes at least one piston slidably received within the at least one second pressure chamber. The at least one second pressure chamber includes a seal for sealingly engaging the piston to fluidly seal the at least one second pressure chamber from the at least one first pressure chamber.

In certain embodiments according to the foregoing aspects, the hydraulic actuation arrangement includes a piston element centered along the longitudinal axis and surrounding the stator assembly. The piston element includes a seal therein that radially seals against an interior surface of an outer housing of the rotor assembly, and radially seals against an exterior surface of the stator assembly. The at least one first pressure chamber is formed on one side of the seal. The at least one second pressure chamber is formed on another side of the seal. A portion of the piston element has interior and exterior threads. A portion of the exterior of the stator assembly has threads. A portion of the interior of the outer housing of the rotor assembly has threads. The interior threads threadably engage the threads of the stator assembly. The exterior threads threadably engage the threads of the outer housing of the rotor assembly such that the piston element is linearly and rotationally movable along the longitudinal axis relative to the stator assembly.

The rotary actuator may also include at least one connection element formed on an exterior of the rotor assembly. The at least one connection element is configured to connect the rotor assembly to a unison ring of the compressor section of the turbine engine.

In yet another aspect, the invention provides a method of actuating the unison rings of a compressor section of a turbine engine using a rotary actuator. The method includes a step of supplying fluid at a first pressure to at least one pressure chamber of a hydraulic actuation arrangement of the rotary actuator. The method also includes a step of supplying fluid at a second pressure to at least one second pressure chamber of the hydraulic actuation arrangement of the rotary actuator. The steps of supplying the fluid at first and second pressures creates a force imbalance acting upon the hydraulic actuation arrangement to rotate a rotor assembly of the hydraulic actuation arrangement relative to a stator assembly about a longitudinal axis of the rotary actuator.

Other aspects, objectives and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention and, together with the description, serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Turning now to the drawings, several embodiments of a rotary actuator according to the teachings of the present invention are illustrated therein. As will be understood from the following, the rotary actuator according to the invention herein overcomes existing problems in the art of torque tube style rotary actuators in that it does not require a separate exterior actuator to provide its actuating force. Instead, it utilizes a hydraulic actuation arrangement formed internally therein for rotating a rotor arrangement thereof relative to a stator arrangement thereof ultimately to govern the position of one or more unison rings of a compressor section of a turbine engine. As a result, the invention provides an improvement over other rotary actuators in that it presents a reduction of parts with a retention of function, and also presents a lower cost, smaller footprint, less complex system for actuating one or more unison rings.

Figure 1:
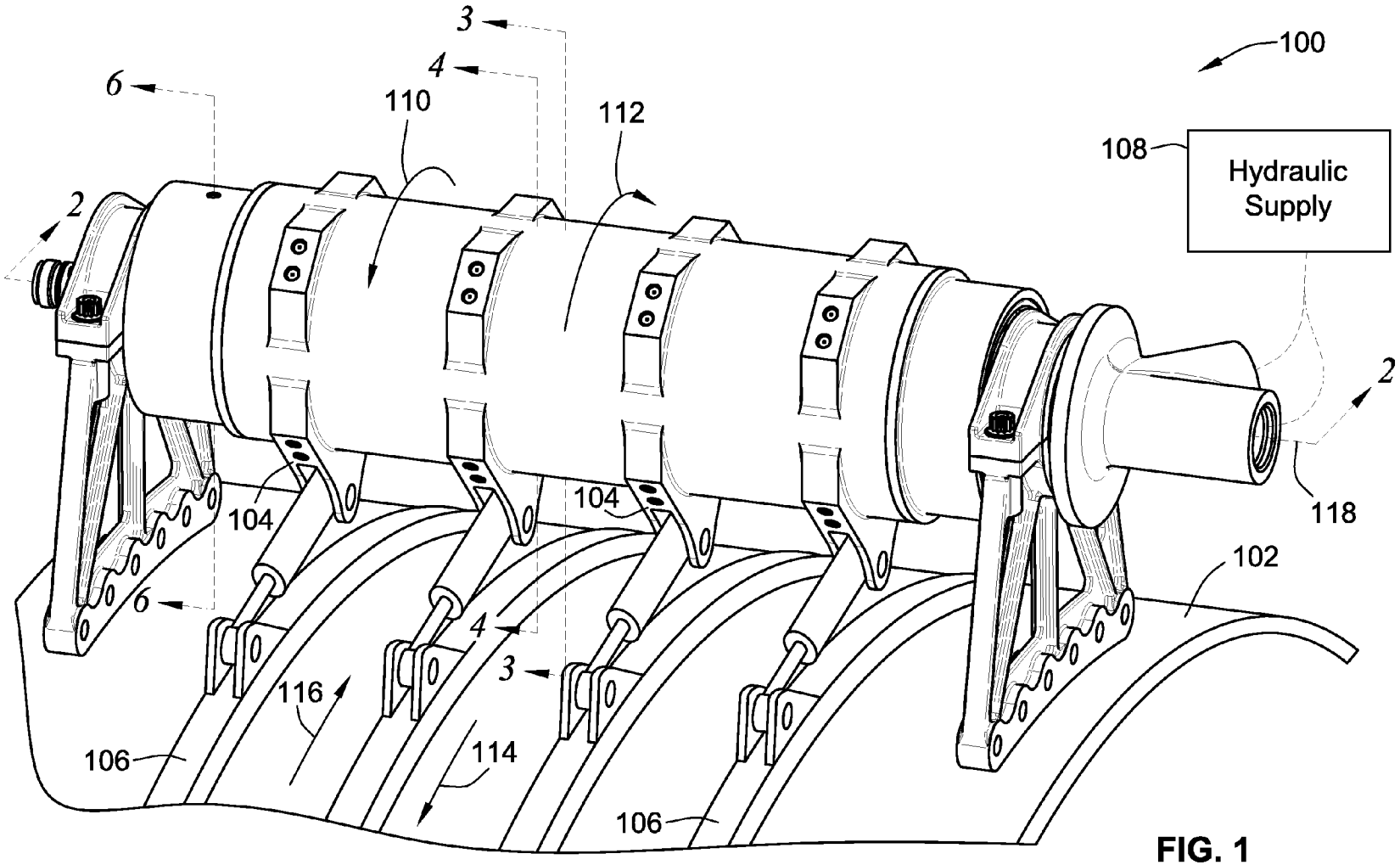
FIG. 1 is a perspective view of a first embodiment of a rotary actuator according to the teachings of the present invention.

With specific reference to FIG. 1, a first embodiment of a rotary actuator 100 is illustrated therein. Rotary actuator 100 is shown mounted to a portion of a compressor housing of a compressor section of a turbine engine. It will be understood from the following that the invention herein is not in any way limited to any particular configuration of turbine engine, and as such, compressor housing 102 and its associated structure is shown generally schematically for purposes of illustration.

A plurality of connection elements 104 of rotary actuator 100 are connected by linkages to a plurality of unison rings 106 mounted proximal an exterior of compressor housing 102. As is well known in the art, unison rings 106 are respectively mounted to arrays of rotary stator vanes, and are rotatable to govern the position of arrays of these rotary stator vanes which are connected thereto. The unison rings 106 are shown generally schematically, and their connection to the arrays of rotary stator vanes has been omitted for purposes of clarity. Also for purposes of clarity, the additional arrays of rotary stator vanes themselves are not illustrated, and in any event, are in no way limiting on the invention herein. Further, the particular number and angular orientation about axis 118 of connection elements 104 may vary depending upon application. Yet further, it will also be recognized that multiple actuators 100 may be arranged on single compressor section where there is a significant number unison rings 106 to actuate. It will be recognized that the foregoing variations apply equally well to actuators 200, 300 described below.

Rotary actuator 100 is operably connected to a hydraulic supply 108. Hydraulic supply 108 provides the appropriate hydraulic pressure to actuate rotary actuator 100 as described herein. Indeed, the hydraulic pressure provided by hydraulic supply 108 is operable to rotate the rotor arrangement of rotary actuator 100 in first and second rotational directions 110, 112 as illustrated. Hydraulic supply 108 may be a stand-alone hydraulic system, or a sub-module of an existing hydraulic system, such as a fuel supply system as one example. Further, hydraulic supply 108 may be integrated directly with the actuator, for example by way of an integrated Electro-Hydraulic Servo Valve (EHSV). Rotation in first rotational direction 110 results in a corresponding rotation of unison rings 106 in direction 116. Likewise, rotation of the rotor arrangement in second rotational direction 112 results in a rotation of unison rings 106 in direction 114.

Figure 2:
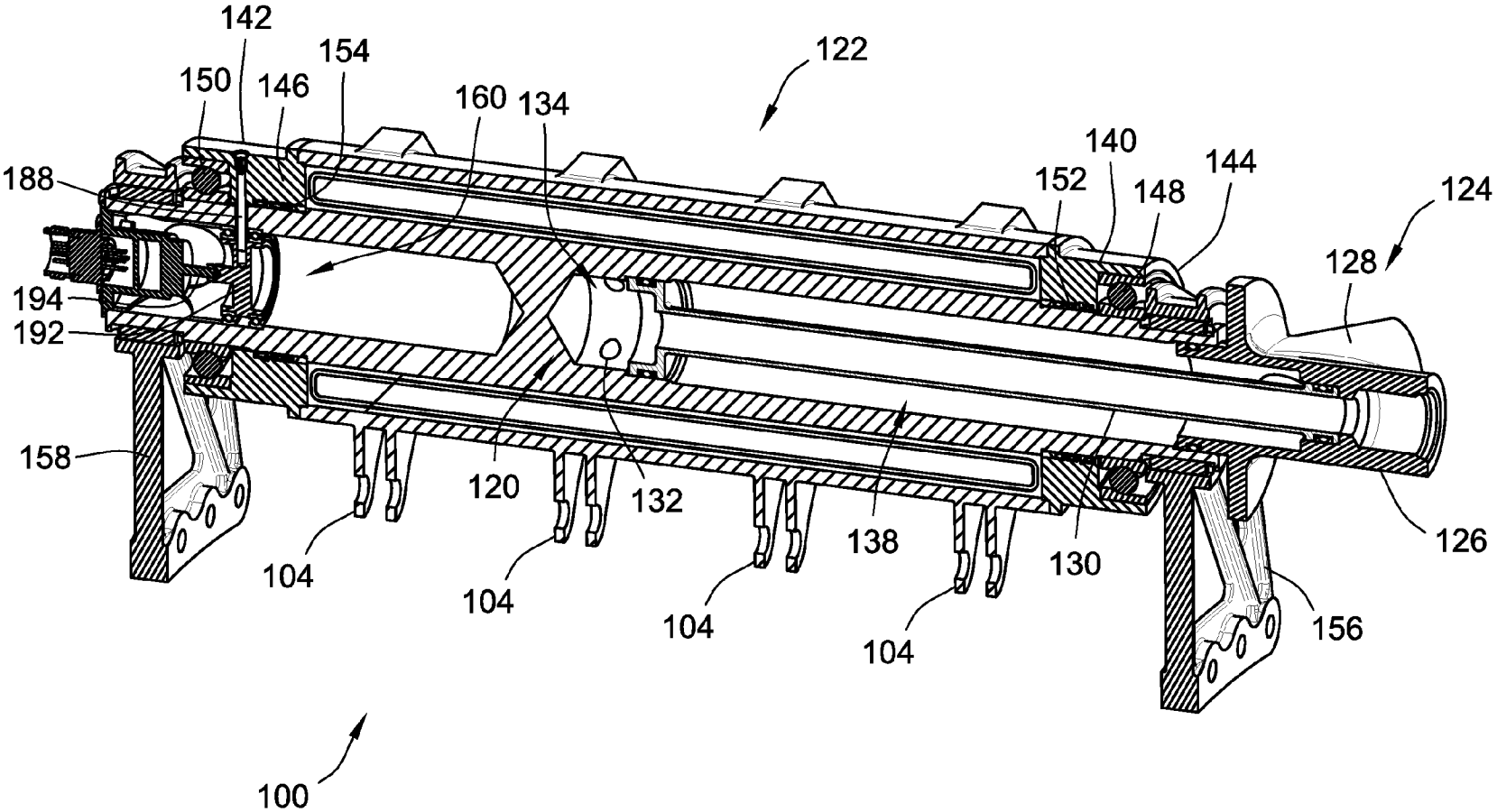
FIG. 2 is a cross section of the rotary actuator of FIG. 1.

Turning to FIG. 2, rotary actuator 100 is illustrated in cross-section. Rotary actuator 100 includes a stator assembly 120 which is centered along a longitudinal axis 118 (See FIG. 1) of rotary actuator 100. Concentric with stator assembly 120, and radially exterior thereof, is a rotor assembly 122 which is rotatable relative to stator assembly 120 to ultimately govern the angular position of connection elements 104 about axis 118. This rotor assembly provides a single stage of rotation. However, in other embodiments, rotor assembly may offer multiple stages which are rotatable relative to one another. As will be explained in greater detail below, a hydraulic actuation arrangement is formed between stator assembly 120 and rotor assembly 122 to rotate rotor assembly 122 relative to stator assembly 120.

Inlet manifold 124 is mounted at one axial end of rotor assembly 100. As can be seen from the cross-section in FIG. 2, inlet manifold 124 extends into stator assembly 120 and is sealingly mounted therewith to prevent any hydraulic fluid leakage. Inlet manifold 124 includes a first inlet 126 and a second inlet 128. An inlet tube 130 communicates first inlet 126 with at least one first inlet port, and in the illustrated embodiment, a plurality of first inlet ports 132 formed in a first inlet chamber 134. As can be seen in FIG. 2, first inlet tube 130 extends within an internal chamber of stator assembly 120.

Second inlet 128 communicates with at least one second inlet port, and in the illustrated embodiment, a plurality of second inlet ports 136 (see FIG. 3) formed in a second inlet chamber 138 of stator assembly 120. Inlet tube 130 extends within the internal chamber of stator assembly 120 and is sealingly mounted at its end therein as shown so as to fluidly separate first inlet chamber 134 and second inlet chamber 138. As a result, and as will be described below, fluid at a first pressure may be supplied through first inlet 126 and at a second pressure through inlet 128. The plurality of inlet ports 132 communicate with a first plurality of pressure chamber of the hydraulic actuation arrangement. The plurality of second inlet ports 136 (see FIG. 3) communicate with a plurality of second pressure chambers of the hydraulic actuation arrangement. Because these first and second pressure chambers receive fluid at differing pressures, a hydraulic rotational actuation of rotor assembly 122 is achieved as discussed below.

A pair of bearing cap assemblies 140, 142 are mounted at opposed axial end portions of rotary actuator 100. Each bearing cap assembly 140, 142 includes an outer rotatable member 144, 146 which is rigidly connected to rotor assembly 122 such that they are each rotatable therewith. Each bearing cap assembly 140, 142 also includes an internal bearing element 148, 150 formed between an outer wall of stator assembly 120 and an inner wall of outer rotatable members 144, 146 as shown. Each bearing cap assembly 140, 142 also includes seals 152, 154 positioned between the outer wall of stator assembly 120 and an interior wall of outer rotatable members 144, 146. Seals 152, 154 prevent leakage from the hydraulic actuation arrangement formed between stator assembly 120 and rotor assembly 122.

A pair of bracket members 156, 158 are exposed axially beyond each of bearing cap assemblies 142, 144. Bracket members 156, 158 are rigidly connected to stator assembly 120, and are operable to mount rotary actuator 100 to a compressor section of a turbine engine as generally illustrated at FIG. 1. It will be recognized by those of skill in the art that the particular mounting configuration provided by each of bracket members 156, 158 will vary depending upon the compressor section that it will be associated with. As such, the illustrated shape and design of each bracket member 156, 158 is not in any way limiting on the invention.

A rotational position sensor 160 is formed between stator assembly 120 and rotor assembly 122. Rotational position sensor 160 is operable to detect and provide an associated signal with respect to the angular position of rotor assembly 122 relative to stator assembly 120. Although not illustrated, it will be immediately recognized that rotational position sensor 160 may be connected to a controller which provides the appropriate modulation of the hydraulic pressures provided at inlets 126, 128 to govern the angular position of rotor assembly 122 relative to stator assembly 120, ultimately to govern the position of unison rings 106 shown in FIG. 1.

Figure 3:
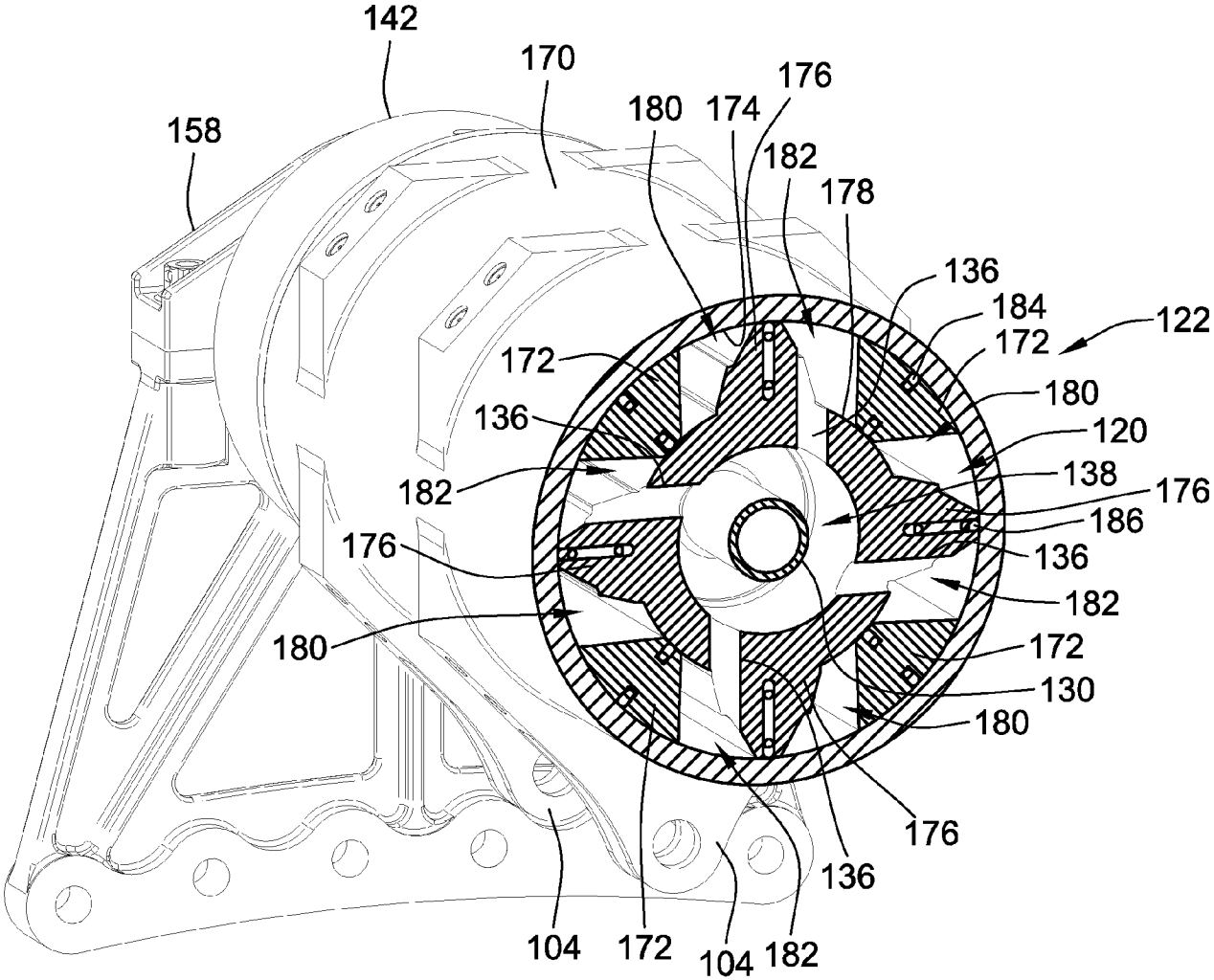
FIG. 3 is another cross section of the rotary actuator of FIG. 1.

Turning now to FIG. 3, the hydraulic actuation arrangement formed between stator assembly 120 and rotor assembly 122 will be described in greater detail. As shown in FIG. 3, rotor assembly 122 includes an outer housing 170. A plurality of rotor vanes 172 extend from an interior surface 174 of outer housing 170 and sealingly contact an exterior surface 178 of stator assembly 120. As can be seen in FIG. 3, these rotor vanes 172 are oriented respectively at the 1 o'clock, 4 o'clock, 7 o'clock, and 10 o'clock angular positions relative to longitudinal axis 118 (See FIG. 1) of rotary actuator 100. As will be described in greater detail below, however, the angular position of these rotor vanes 172 will change depending upon the input pressures supplied by hydraulic supply 108 (See FIG. 1). Further, the particular angular location of rotor vanes 172 shown in FIG. 3 (i.e. the 1 o'clock, 4 o'clock, 7 o'clock, and 10 o'clock angular positions) is not limiting on the invention, as other angular positions may be utilized, e.g. the 2 o'clock, 5 o'clock, 8 o'clock, and 11 o'clock angular positions.

Stator assembly 120 is generally cross-shaped and includes a plurality of stator vanes 176 which project therefrom to make contact with interior surface 174 of outer housing 170. These stator vanes 176 are shown at the 12 o'clock, 3 o'clock, 6 o'clock, and 9 o'clock angular positions relative to longitudinal axis 118 (See FIG. 1) of rotary actuator 100. The angular position of stator vanes 176 remains fixed.

The above introduced plurality of first and second pressure chambers 180, 182 are formed between the rotor and stator vanes 172, 176. More specifically, one of the first pressure chambers is formed on one side of each stator vane, while the second pressure chamber 182 is formed on the other side of each stator vane 176. A plurality of rotor seals 184, and stator seals 186 are mounted on each of rotor vanes 172 and stator vanes 176 so as to fluidically seal each first pressure chamber 180 from each second pressure chamber 182.

Still referring to FIG. 3, as discussed above, a plurality of second inlet ports 136 fluidly communicate fluid provided through second inlet 128 (see FIG. 2) with the plurality of second pressure chambers 182. As such, each of these second pressure chambers 182 are pressurized at the pressure provided by the fluid through second inlet 128.

Figure 4:
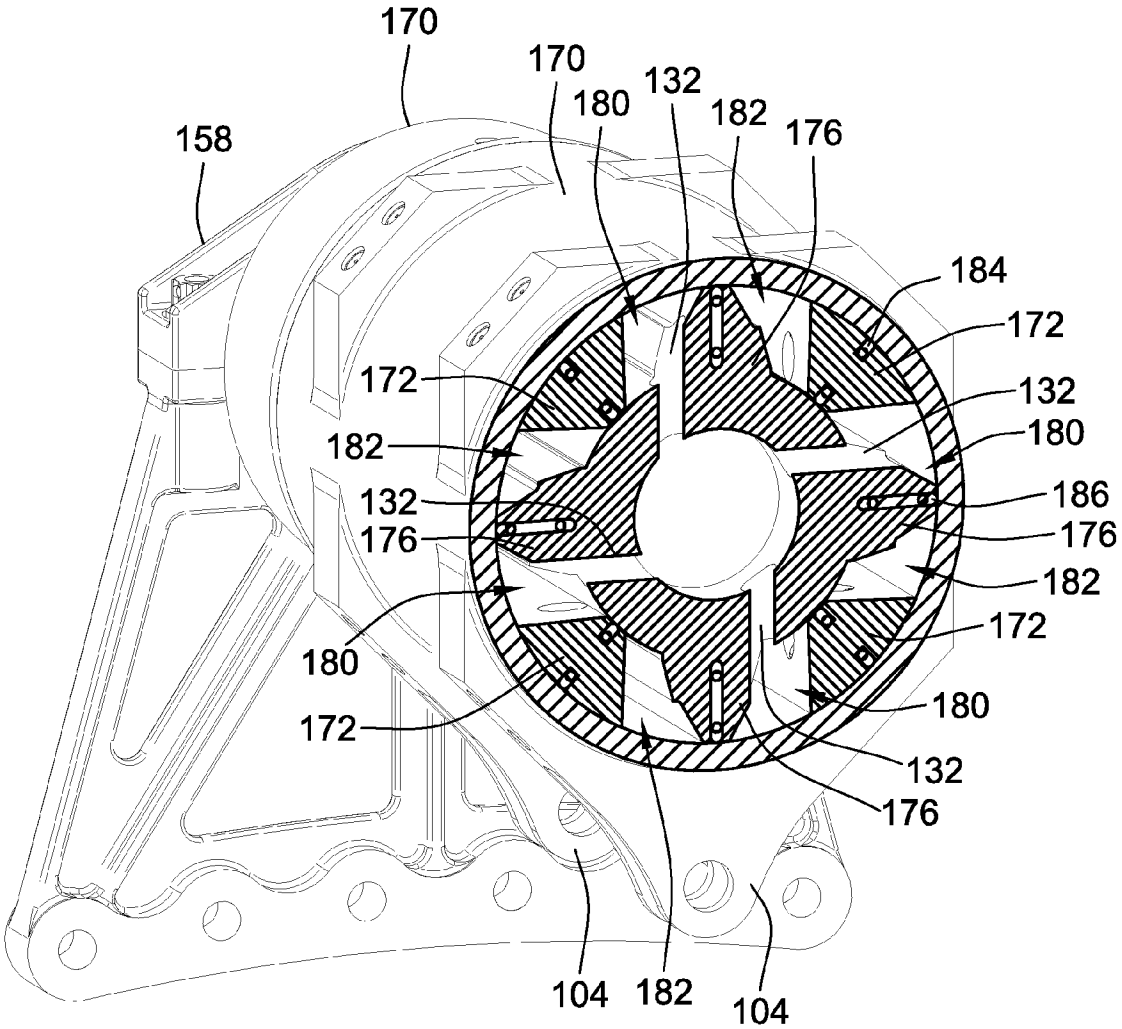
FIG. 4 is another cross section of the rotary actuator of FIG. 1.

Similarly, and turning now to FIG. 4, first inlet ports 132 fluidly communicate first inlet 126 (see FIG. 2) with first pressure chambers 180. First pressure chambers 180 are thus pressurized at the same pressure as the fluid provided through first inlet 126. Hydraulic supply 108 (see FIG. 1) is operable to provide differing pressures at first and second inlets 126, 128. As a result, each of first pressure chambers 180 may be at a different pressure than each of pressure chambers 182. This pressure imbalance creates a resultant force imbalance on opposing sides of each of rotor vanes 172 and stator vanes 176 thereby causing rotor assembly 122 to rotate about axis 118 (See FIG. 1). As discussed above, this rotation is ultimately responsible for rotating unison rings 106 to their desired position to govern the angular orientation of variable stator vanes connected thereto. As such, the hydraulic actuation arrangement formed by rotor vanes 172, stator vanes 176 and first and second pressure chambers 180, 182 overcomes existing actuators in the art as all actuation force is provided hydraulically from within rotary actuator 100 as opposed to an externally applied force as discussed above.

Figure 5:
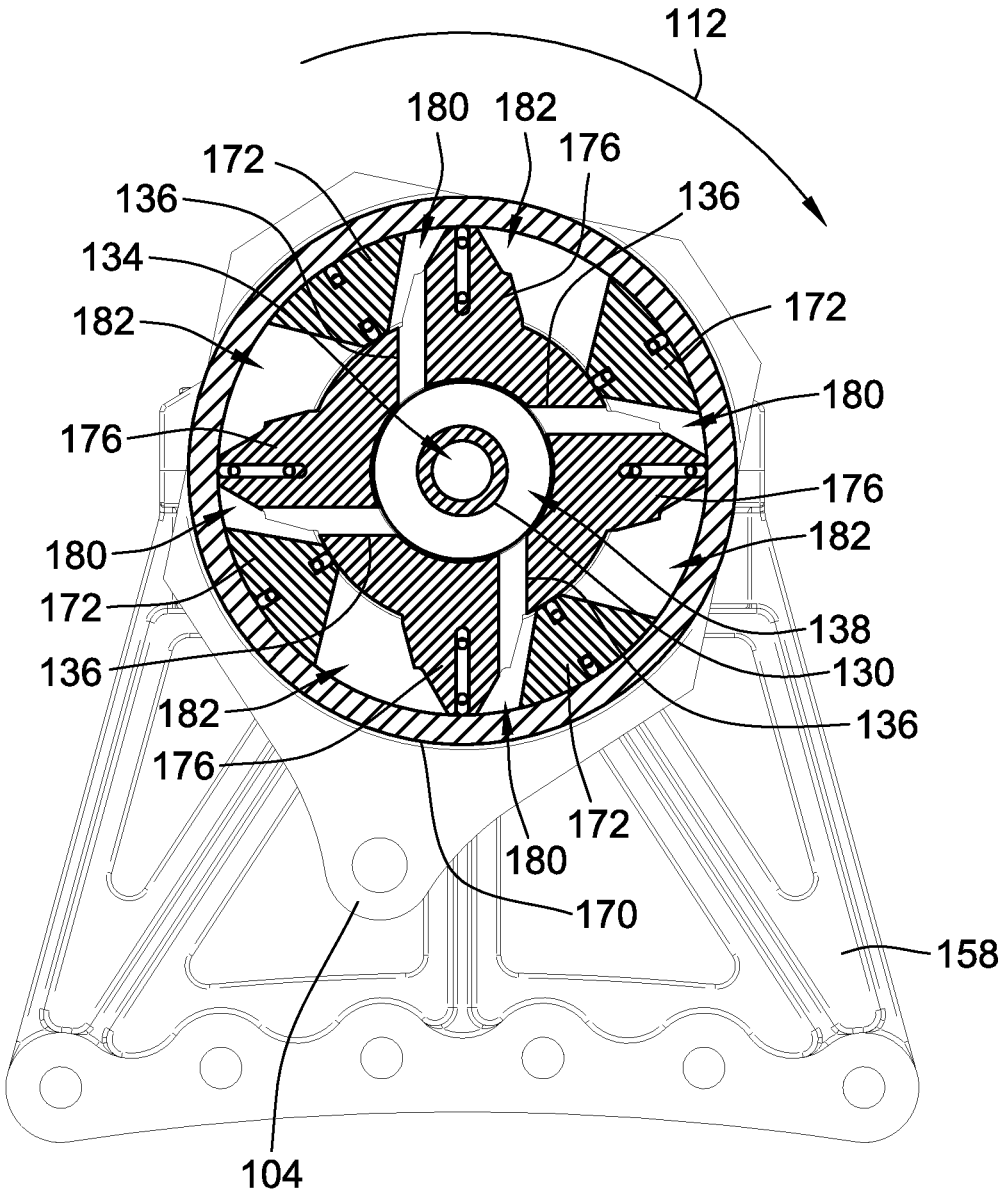
FIG. 5 is another cross section of the rotary actuator of FIG. 1.

Turning now to FIG. 5, the same illustrates the result of the above-described pressure differential between first pressure chambers 180 and second pressure chambers 182. As can be seen in this view, each of second pressure chambers 182 are at a higher pressure than each of first pressure chambers 180. As a result, rotor assembly 122 has rotated in second rotational direction 112 to vary the angular orientation thereof relative to axis 118 (See FIG. 1). Due to the rigid extension of connection elements 104 on outer housing 170, the angular position of connection elements 104 has also changed. As discussed above relative to FIG. 1, these connection elements 104 are coupled via linkages to unison rings 106.

Accordingly, movement into the orientation shown at FIG. 5 also results in a movement of each unison ring 106 in rotational direction 114. The opposite also holds true. That is, where the pressure in each of pressure chambers 180 is greater than that of the pressure in each of pressure chambers 182, rotor assembly 122 will rotate in first rotational direction 110 as shown in FIG. 1 ultimately resulting in movement of each unison ring and rotational actuation direction 116. Thus, each of first pressure chambers 180 and second pressure chambers 182 have a variable volume. It will be recognized that fewer or less rotor and stator vanes 172, 176 may be utilized to achieve the above-described functionality. As such, the use of four rotor vanes 172 and four stator vanes 176 should be taken by way of example and not limitation. Indeed, a single rotor vane 172 and a single stator vane 176 could be utilized to form a single first pressure chamber 180 and a single second pressure chamber 182.

Figure 6:
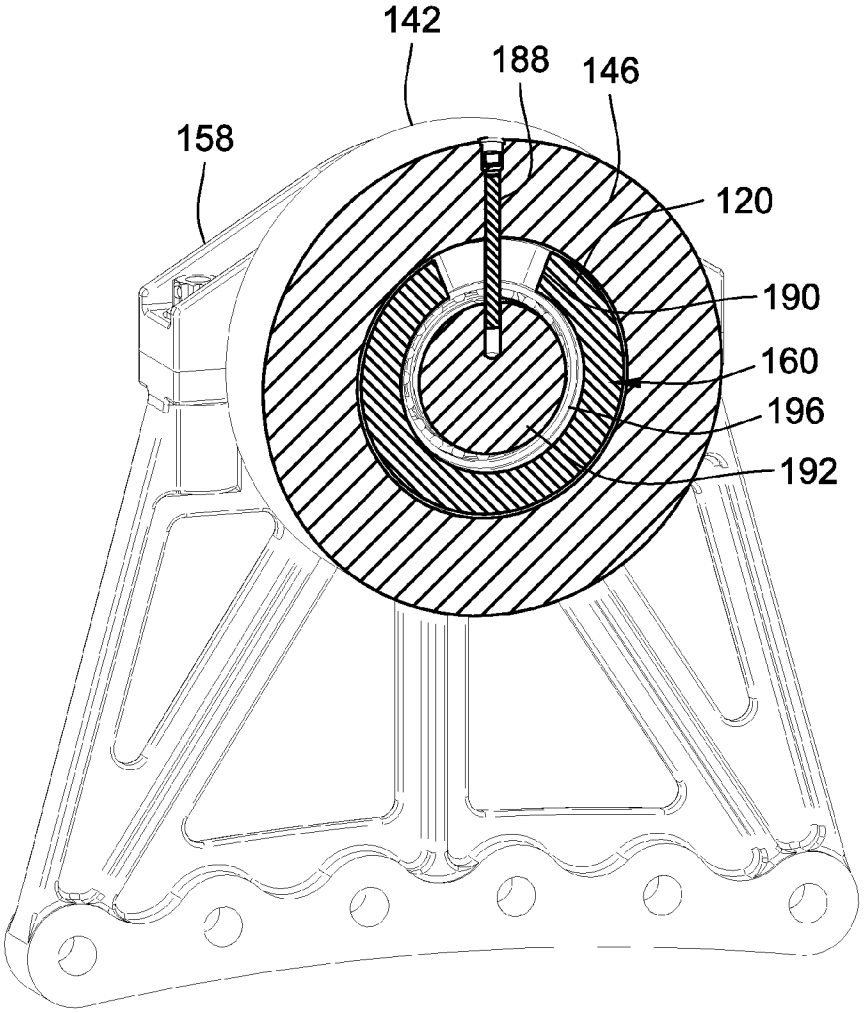
FIG. 6 is another cross section of the rotary actuator of FIG. 1.

Turning now to FIG. 6, the above-introduced sensor 160 will be described in greater detail. As can be seen in the cross-section of FIG. 6, sensor 160 includes a pin 188 which is rigidly connected with outer rotational member 146 of bearing cap assembly 142. As a result, any rotation of outer rotational member 146 commensurate with the rotation of rotor assembly 122 as described above, also results in a like rotation of pin 188. Pin 188 extends through an arcuate slot 190 formed through stator assembly 120 as illustrated. Pin 188 is connected to a rotational element 192 of sensor 160. Rotational element 192 is disposed within an interior of stator assembly 120 and rotationally mounted therein by way of a bearing 196. As a result, rotational element 192 rotates with the rotation of pin 188 and thus ultimately the rotation of rotor assembly 122. The particular angular span of arcuate slot 190 may vary depending upon the limits of rotation in either of first and second rotational directions 110, 112 (See FIG. 1) based on the particular design of rotary actuator 100. As such, the angular span illustrated for arcuate slot 190 should be taken by way of example only.

With brief reference back to FIG. 2, rotational element 192 is coupled with an arm of a rotational sensor 194 of sensor 160. As such, rotation of rotational element 192 results in a like rotation of rotational sensor 194. Rotational sensor 194 converts this rotation to an electrical signal which is thereafter supplied to a controller as discussed above.

Figure 7:
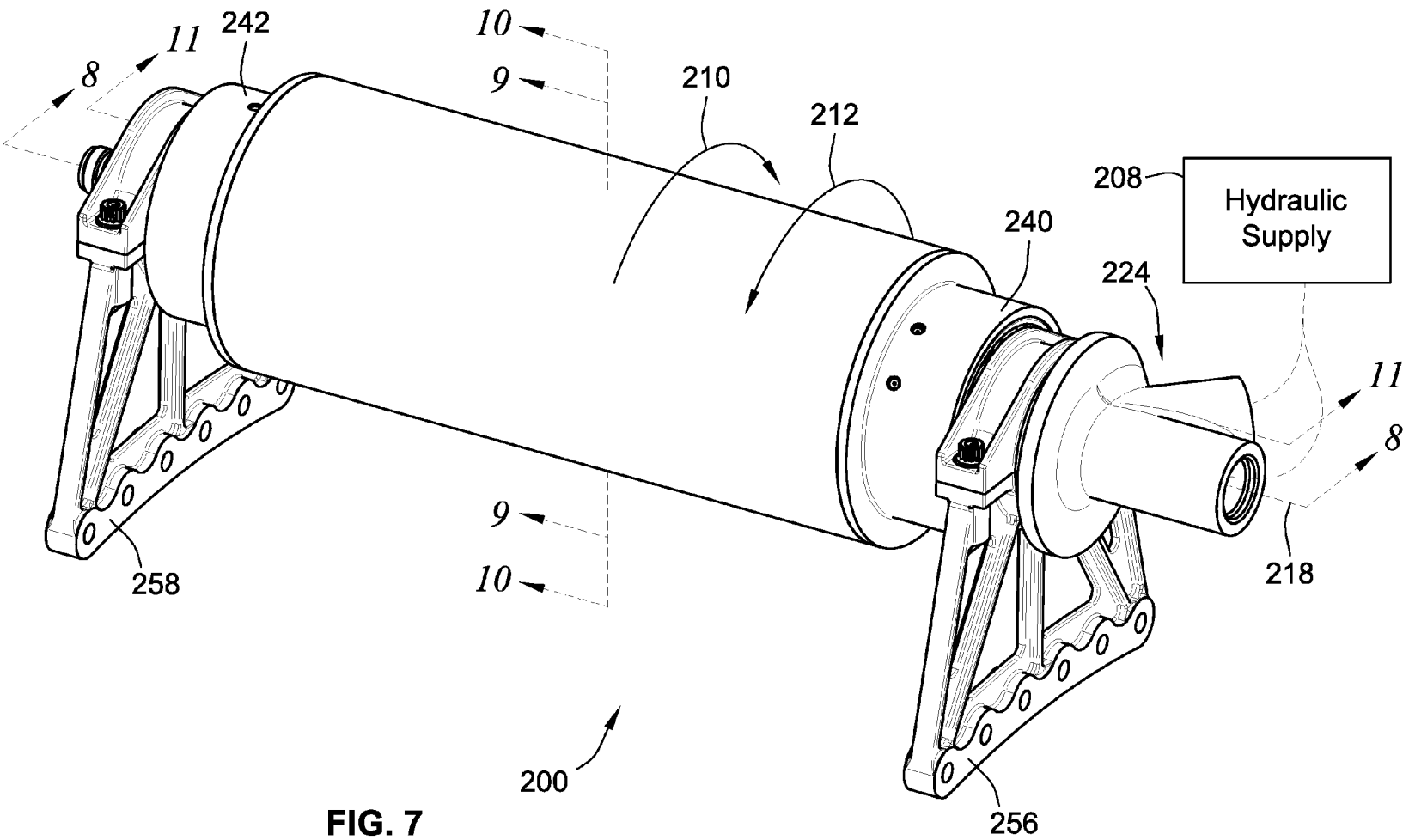
FIG. 7 is a perspective view of a second embodiment of a rotary actuator according to the teachings of the present invention.

Turning now to FIG. 7, a second embodiment of a rotary actuator 200 according to the teachings of the present invention is illustrated therein. This embodiment of rotary actuator 200 is substantially similar to the embodiment discussed above relative to FIGS. 1-6, except for the construction of the rotor and stator assemblies therein. As a result, the rotary actuator 200 has a structurally different hydraulic actuation arrangement formed between the rotor and stator assemblies to rotate the rotor assembly of rotary actuator 200 in first and second rotational directions 210, 212. Rotary actuator 200 may be coupled to the identical compressor section as that shown in FIG. 1, and is thus operable to govern the rotational position of a plurality of unison rings in the same manner as described above.

Rotary actuator 200 includes bearing cap assemblies 240, 242 which are identical in function and structure as that described above relative to bearing cap assemblies 140, 142, with one exception relative to bearing cap assembly 240 discussed below. Likewise, rotary actuator 200 employs bracket members 256, 258 which are identical in the function and structure as that described above relative to bracket members 156, 158. Rotary actuator 200 also includes a manifold 224 which is fluidly coupled to a hydraulic supply 208. Manifold 224 is also identical in function and structure as that described above relative to manifold 124. The same holds true for hydraulic supply 208 relative to hydraulic supply 108.

Figure 8:
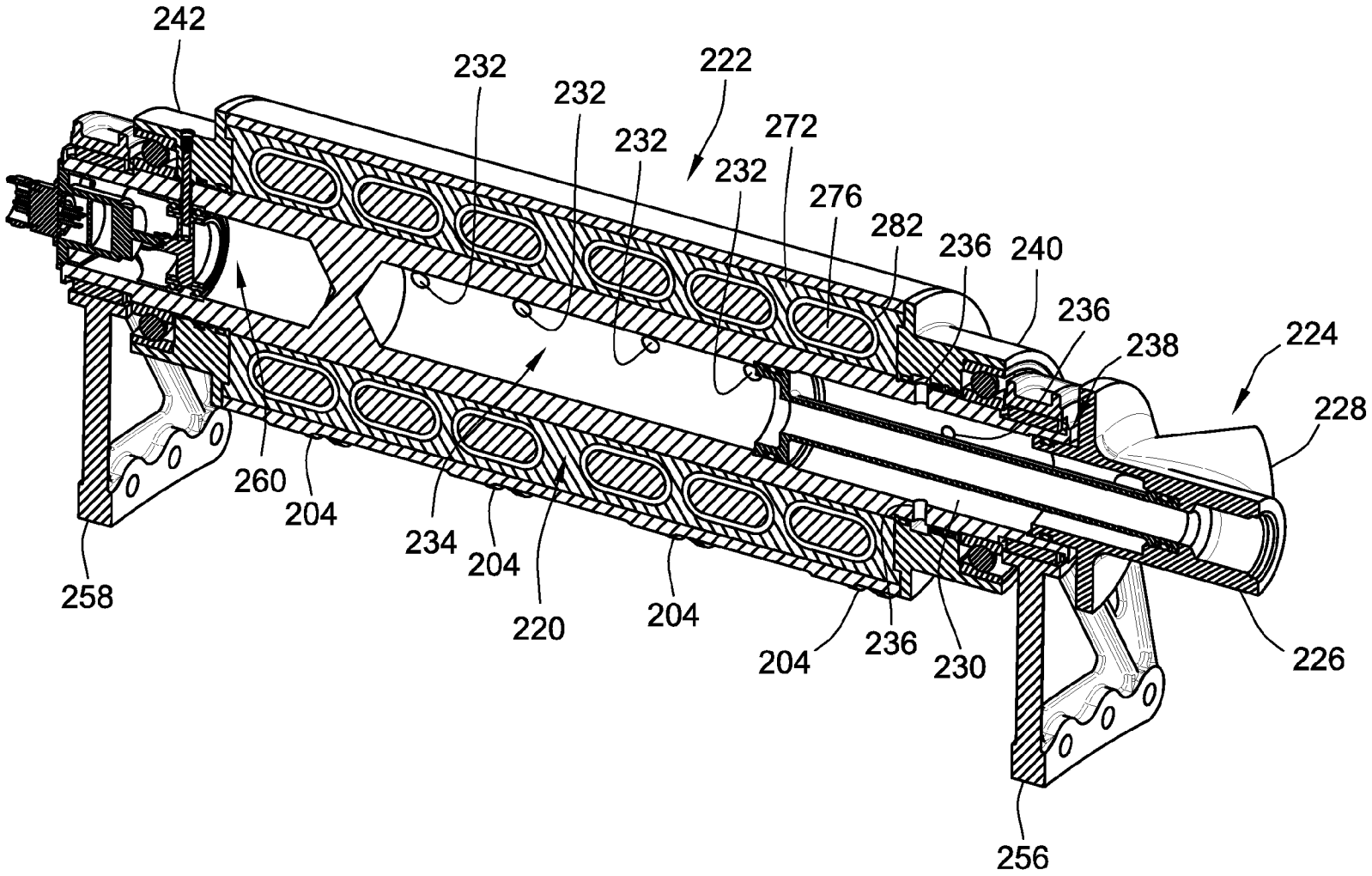
FIG. 8 is a cross section of the rotary actuator of FIG. 7.

With the above-described similarity established, a structural description will be provided for the particular actuation arrangement of rotary actuator 200. With particular reference now to FIG. 8, manifold 224 includes a first inlet 226 and a second inlet 228. An inlet tube 230 fluidly communicates inlet 226 with at least one first inlet port, and in the illustrated embodiment, a plurality of first inlet ports 232 formed in a first inlet chamber 234. Second inlet 228 is in fluid communication with at least one second inlet port, and in the illustrated embodiment, a plurality of second inlet ports 236 disposed within a second inlet chamber 238. First inlet ports 232 are in fluid communication with one or more first pressure chambers. Second inlet ports 236 are in fluid communication with one or more second pressure chambers. Hydraulic supply 208 (See FIG. 7) is operable to provide fluid to inlets 226, 228 at differing pressures so as to create a pressure imbalance similar to that described above ultimately to rotate rotor assembly 222 relative to stator assembly 220.

More specifically, and still referring to FIG. 8, instead of utilizing a plurality of rotor and stator vanes such as that described above relative to rotary actuator 100, rotary actuator 200 utilizes a rotor assembly that includes a core member 272 which defines the one or more second pressure chambers 282. As will be described in greater detail below, stator assembly 220 includes a plurality of pistons 276 which are received in second pressure chambers 282. The first pressure chambers 280 in this embodiment are formed around an exterior of core member 272 as will be described below.

Also as shown in FIG. 8, rotary actuator 200 utilizes a sensor 260 which is identical in its structure and function as that described above relative to FIG. 1. Sensor 260 thus provides for the detection of the particular angular orientation of rotor assembly 222.

Figure 9:
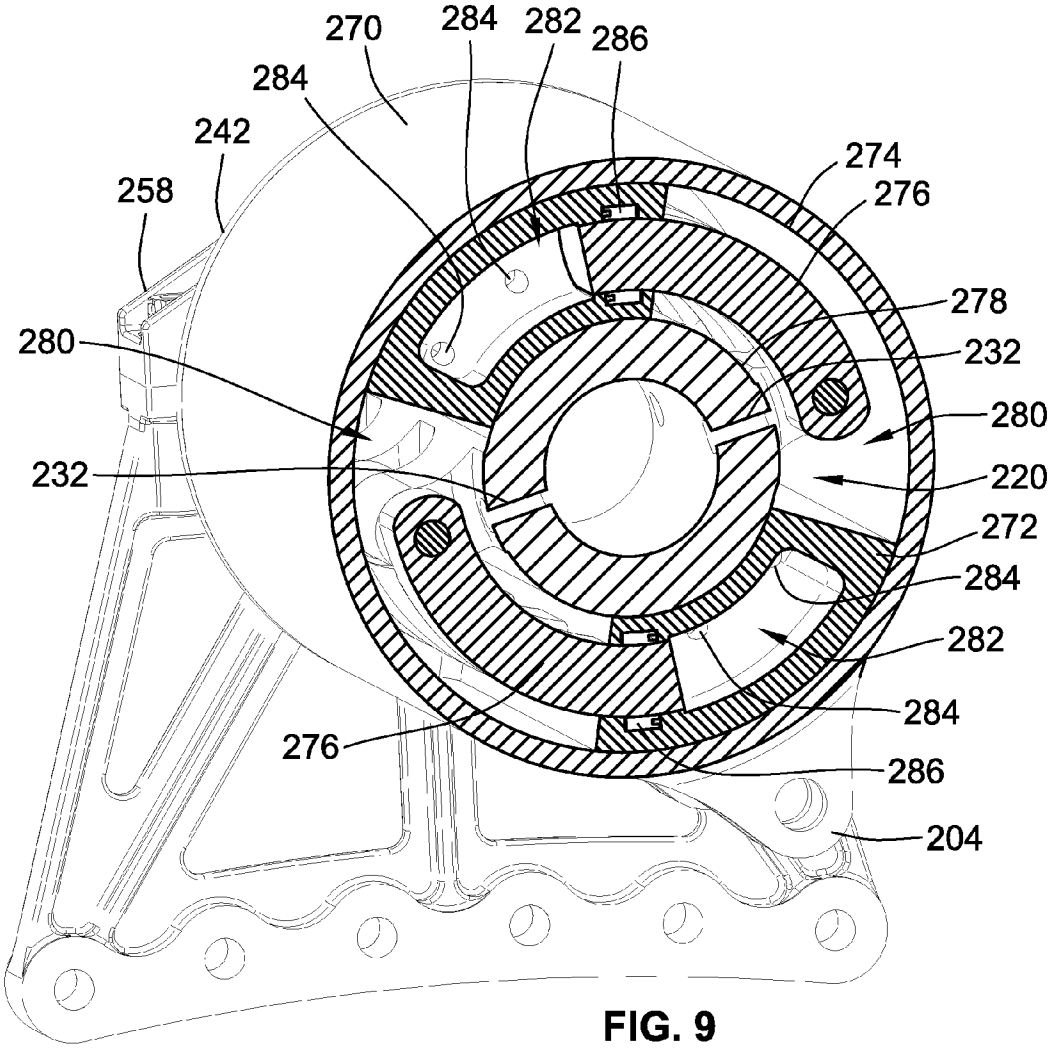
FIG. 9 is another cross section of the rotary actuator of FIG. 7.

More specifically, and turning now to FIG. 9, first and second pressure chambers 280, 282 are illustrated therein. As can be seen in this view, core member 272 is rigidly mounted to an interior surface 274 of a housing 270 of rotor assembly 222. With momentary reference back to FIG. 8, second pressure chambers 282 are arranged in a first bank and a second bank thereof. The first bank of second pressure chambers 282 are arranged in a row and disposed above the second bank of second pressure chambers 282. Turning back to FIG. 9, the first bank of second pressure chambers 282 are in communication with one another by way of cross passages 284 that are in turn in fluid communication with second inlet ports 236 (See FIG. 2). Likewise, the second bank of second pressure chambers are in fluid communication with one another of cross passages 284 as well. These cross passages 284 are also in fluid communication with second inlet ports 236 (See FIG. 8).

As stated above, stator assembly 220 includes a plurality of pistons 276 which are pivotally mounted thereto and received in second pressure chambers 282. Second pressure chambers 282 are sealed with respect to pistons 276 by way of core member seals 286 as shown.

First pressure chamber 280 is formed generally around an exterior of stator assembly 220 and core member 272. This first pressure chamber 280 is continuous, however, segregation of this first pressure chamber to create multiple first pressure chambers 280 is entirely contemplated herein. As discussed above, first pressure chamber 280 receives pressurized fluid from hydraulic supply 208 via first inlet 226, inlet tube 230, and first inlet ports 232. Second pressure chambers 282 receive pressurized fluid from second inlet 228 via second inlet ports 236, and cross passages 284 as described above. In the same manner as that described relative to rotary actuator 100, hydraulic supply 208 is operable to supply pressurized fuel at a first pressure to first pressure chambers 280, and pressurized fluid to second pressure chambers 282 at a second pressure which is different than the first pressure. As a result, there is a pressure imbalance and thus a resultant force imbalance between first and second pressure chambers 280, 282 which will ultimately cause core member 272 thus the remainder of rotor assembly 222 in one of first and second rotational directions 210, 212 as shown in FIG. 8.

As such, the hydraulic actuation arrangement of rotary actuator 200 formed by way of first and second pressure chambers 280, 282 overcomes existing rotary actuators by not requiring an external actuator to provide the force required to rotate rotor assembly 222. It will be recognized that although a number of pressure chambers 282 and corresponding pistons 276 have been described, rotary actuator 200 could perform equally well with only a single second pressure chamber 282 and associated piston 276, or a greater number of second pressure chambers 282 and associated pistons 276 than that shown. As such, the particular number of second pressure chambers 282 should be taken by way of example only.

Figure 10:
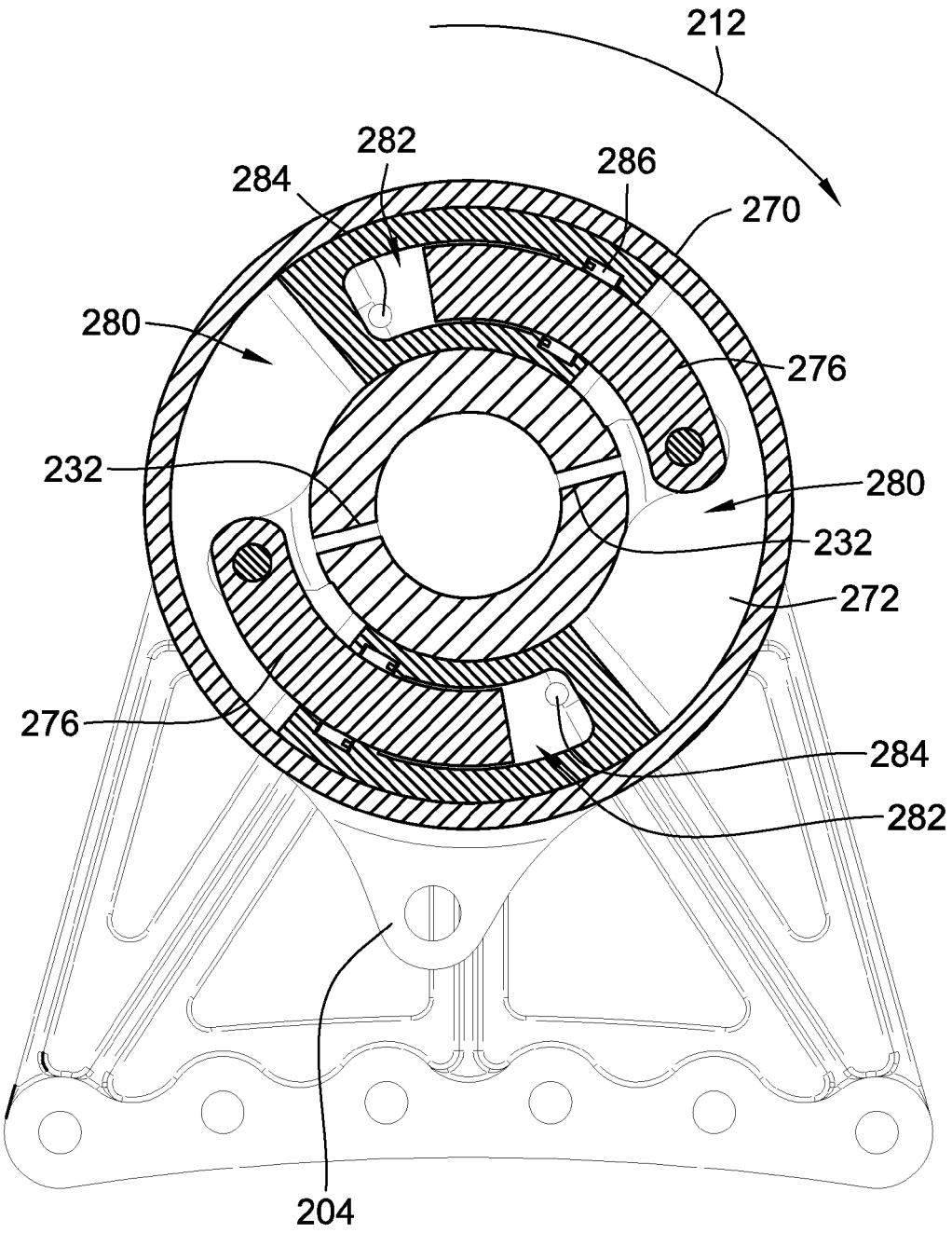
FIG. 10 is another is a cross section of the rotary actuator of FIG. 7.

The effect of the above-described pressure differential is shown in greater detail in FIG. 10. As can be seen in FIG. 10, the pressure in first pressure chambers 280 is greater than that in pressure chambers 282. As a result, core member 272 and rotor housing 270 of rotor assembly 222 have rotated in rotational direction 212 relative to stator assembly 220. As a result, pistons 276 have been displaced to a greater extent within second pressure chambers 282 than that illustrated in FIG. 9. Thus, it can be seen from inspection of FIG. 10 that second pressure chambers 282 have a variable volume as well. Due to the rigid extension of connection elements 204 on rotor housing 270, the angular position of these connection elements 204 has also changed. As discussed above, this change in the angular orientation of connection elements 204 relative to axis 218 (See FIG. 7) results in a corresponding rotation of unison rings connected to connection elements 204. In the same manner as described above, connection elements 204 may vary in their number and angular orientation about axis 218 depending upon application.

Figure 11:
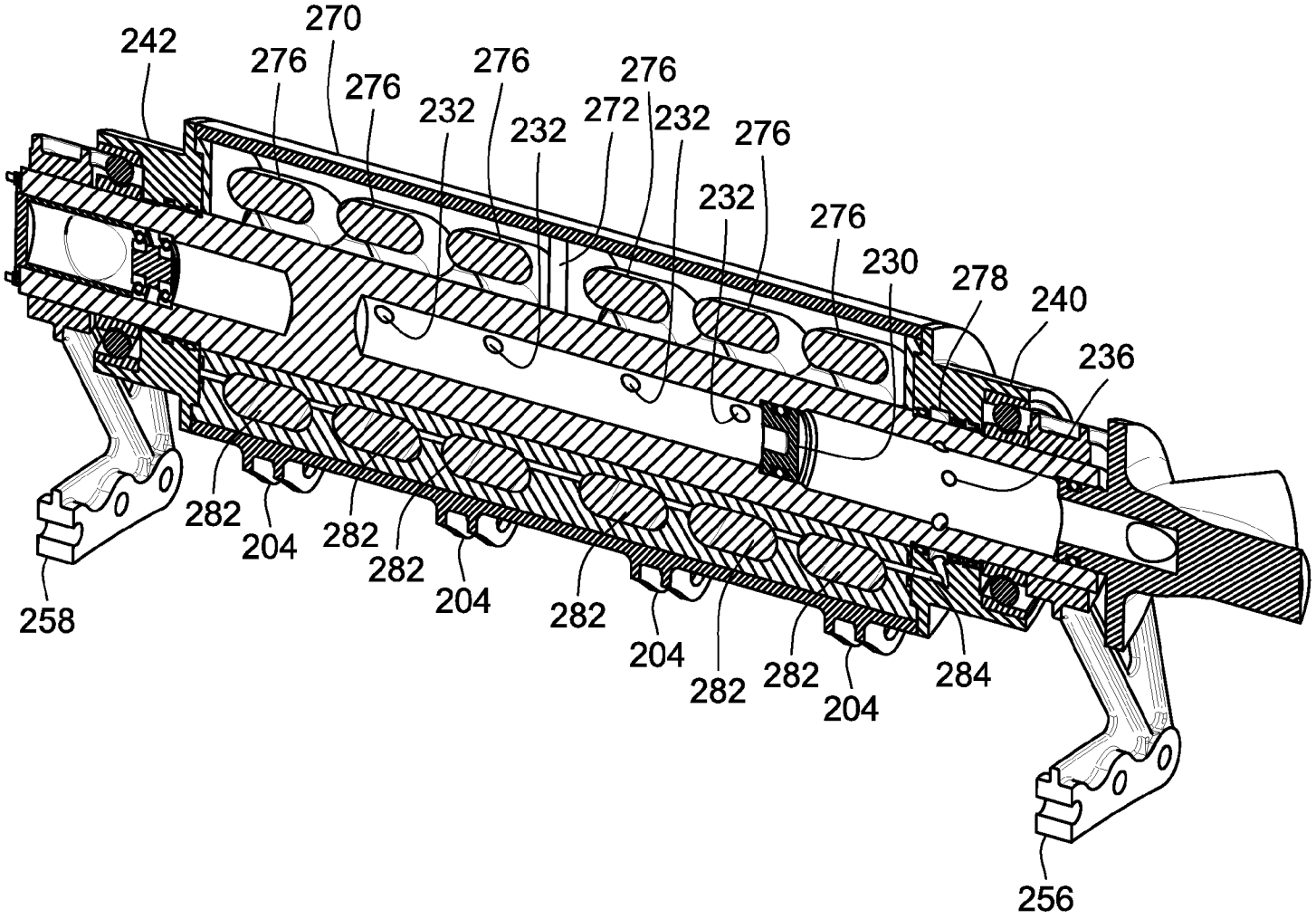
FIG. 11 is another cross section of the rotary actuator of FIG. 7.

Turning now to FIG. 11, the cross-section shown therein is provided to illustrate fluid communication between cross passages 284 and second inlet ports 236. As introduced above, bearing cap assemblies 240, 242 are substantially the same as those discussed above relative to rotary actuator 100 with one notable exception. Bearing cap assembly 240 includes an annular channel 278 that fluidly communicates second inlet ports 236 with cross passages 284. It should also be noted that cross passages 284 extend not only through core member 272, but also into bearing cap assembly 240. Appropriate seals are provided around the junction of bearing cap assembly 240 and core member 272 at cross passages 284 to prevent any leakage therefrom.

Figure 12:
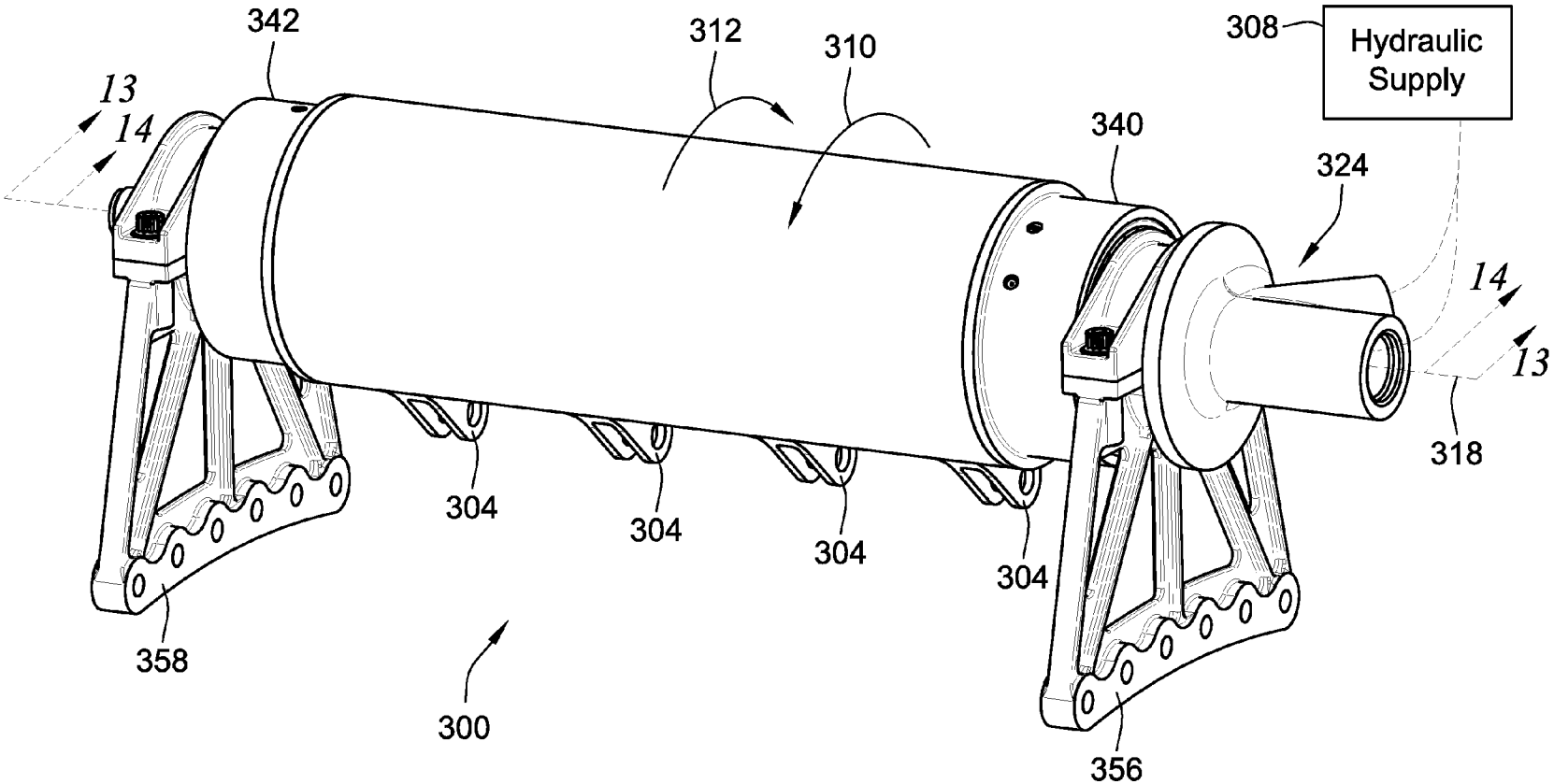
FIG. 12 is a third embodiment of a rotary actuator according to the teachings of the present invention.

Turning now to FIG. 12, a third embodiment of a rotary actuator 300 is illustrated. This embodiment is substantially the same as rotary actuators 100, 200 discussed above with the exception that it also employs a different hydraulic actuation arrangement formed between its rotor assembly and stator assembly as discussed in the following. Rotary actuator 300 includes a manifold 324 which couples the same to a hydraulic supply 308. This hydraulic supply 308 supplies pressurized fluid to the above-referenced hydraulic actuation arrangement to rotate a rotor assembly of rotary actuator 300 in first and second rotational directions 310, 312 in a similar manner as that discussed above.

Rotor actuator 300 includes first and second bearing cap assemblies 340, 342 which are substantially the same in their function and structure but for the exceptions discussed in the following. Likewise, rotary actuator 300 incorporates bracket members 356, 358 which are substantially the same in their structure and function as those discussed above. Bracket members 356, 358 mount rotary actuator 300 to a compressor housing of a compressor section of a turbine engine as discussed above relative to FIG. 1. Rotary actuator 300 includes a plurality of connection elements 304 which may be connected via linkages to unison rings 106 of the compressor section also as discussed above relative to FIG. 1. As was the case with the previous embodiments, the number and angular orientation of connection elements 304 is entirely design specific, and thus the particular number and orientation shown should be taken by way of example only.

Figure 13:
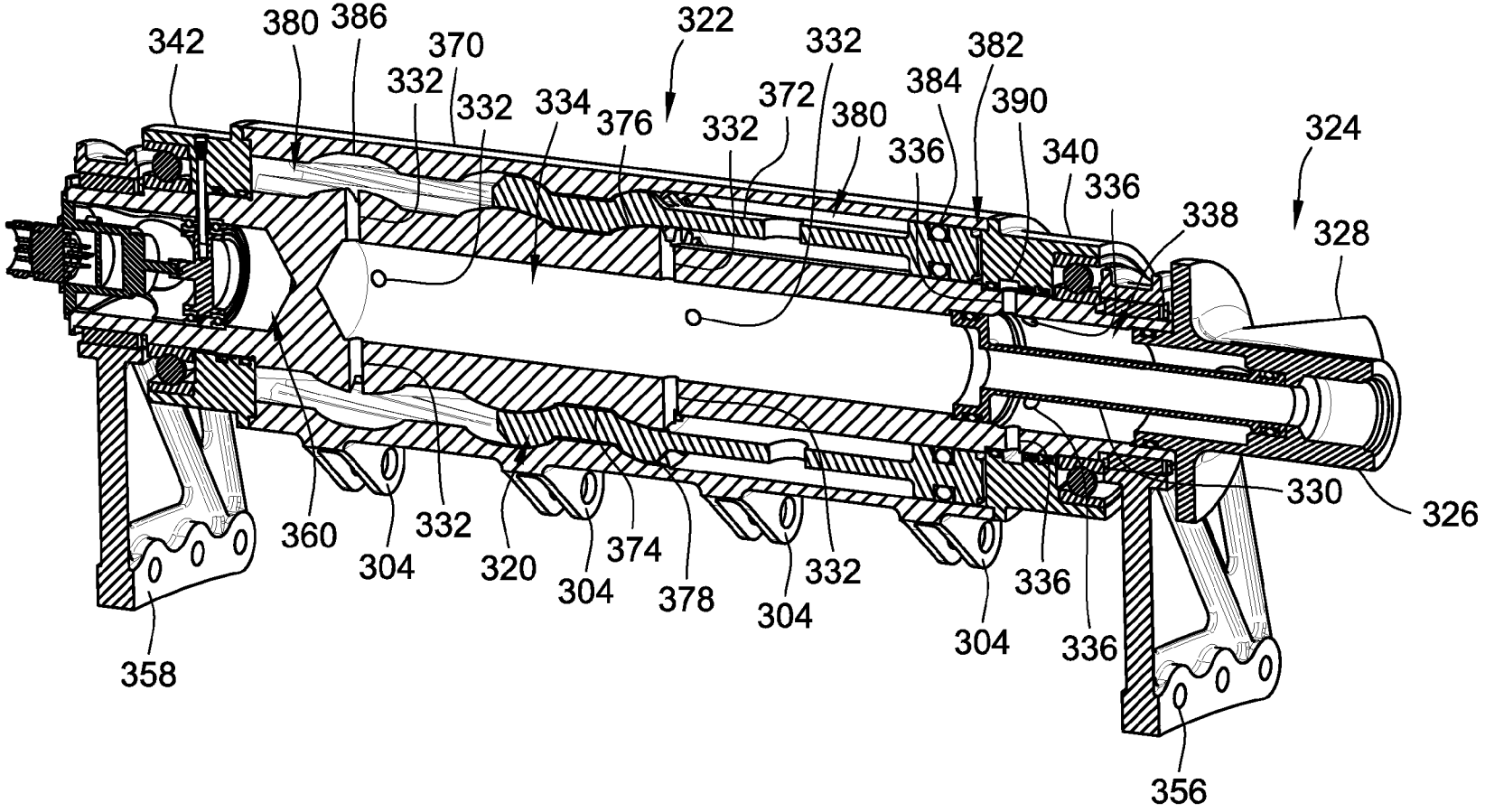
FIG. 13 is a cross section of the rotary actuator of FIG. 12.

Turning now to FIG. 13, a cross-section of rotary actuator 300 is illustrated and the hydraulic actuation arrangement formed between the stator assembly 320 and rotor assembly 322 will be described in greater detail. Manifold 324 includes a first inlet 326 and a second inlet 328. An inlet tube 330 fluidly communicates first inlet 326 with a first inlet chamber 334. At least one first inlet port, and in the illustrated embodiment, a plurality of first inlet ports 332 are disposed within first inlet chamber 334. The inlet ports 332 are used to fluidly communicate pressurized fluid provided through first inlet 326 with a first pressure chamber 380 formed around an exterior of rotor assembly 320. As will be discussed in great detail below, and similar to the embodiments discussed above, first pressure chamber 380 has a variable volume.

Second inlet 328 fluidly communicate fluid provided by hydraulic supply 308 with at least one second inlet port, and in the illustrated embodiment, a plurality of second inlet ports 336 formed in a second inlet chamber 338 of rotor assembly 320. This plurality of second inlet ports provides pressurized fuel from second inlet 328 to a second pressure chamber 382 which also has a variable volume as described in the following. It should be noted that in the configuration shown in FIG. 13, the variable volume of first pressure chamber 380 is near its maximum, while the variable volume of second pressure chamber 382 is near its minimum.

These first and second pressure chambers 380, 382 are formed on opposing sides of a piston element 372 of rotor assembly 322. A piston seal 384 fluidly seals first pressure chamber 380 from second pressure chamber 382. A plurality of helical threads 376 are formed on an exterior portion of stator assembly 320. A plurality of helical threads 386 are formed on an interior portion of a rotor housing 370 of rotor assembly 322. Piston element 372 includes interior and exterior threads 374, 378 formed thereon which respectively mesh with threads 376, 386. As will be discussed in greater detail below, as the pressure increases in second pressure chamber 382, piston element 372 will linearly move from right to left relative to FIG. 13 and also rotate about longitudinal axis 318 (See FIG. 12).

The threaded engagement between piston element 372, stator assembly 320, and rotor housing 370 of rotor assembly 322 is a splined arrangement such that the revolution ratio between piston assembly 372 and rotor housing 370 is 1:2. In other words, rotor housing 370 will rotate twice as much relative to axis 318 as piston element 372. Those skilled in the art will immediately recognize that other ratios are entirely possible depending on particular configuration of the threads discussed above.

The above-described rotation of rotor housing 370 is detected by a sensor 360 which is identical to the sensors discussed above. This information is fed to a controller for control of actuator 300.

Figure 14:
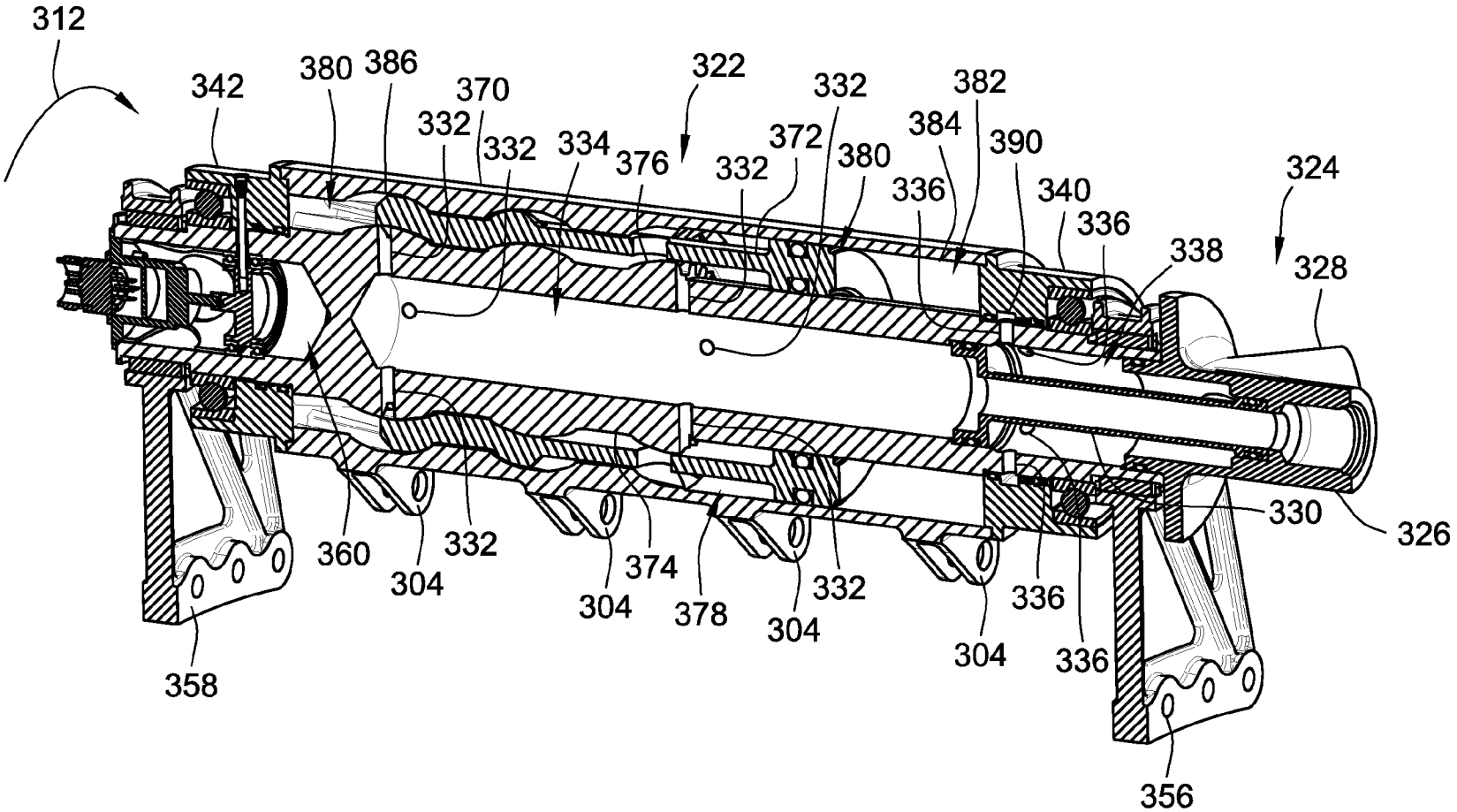
FIG. 14 is another cross section of the rotary actuator of FIG. 12.

Turning now to FIG. 14, the above-described rotation of rotor assembly 322 is shown in greater detail. As can be seen in this view, pressure in second pressure chamber 382 provided by inlet 328 as discussed above has increased to an amount greater than the pressure of first pressure chamber 380. As a result, piston element 372 has linearly and rotationally moved relative to axis 318 and thus by way of the threaded arrangement discussed above caused a corresponding rotation in rotor housing 370. In the same manner as the embodiments described above, connection elements 304 (See FIG. 13) are rigid extensions of rotor housing 370.

As a result, the angular orientation of connection elements 304 relative to axis 318 has changed to ultimately rotate the unison rings of the compressor section discussed above. In the same manner as described above, hydraulic supply 308 is operable to modulate the pressures in first and second pressure chambers 380, 382 to govern the position of piston member 372. Also in a like manner as discussed above, it will be recognized that appropriate cross passages are formed through bearing cap assembly 340 so as to fluidly communicate second pressure chamber 382 with second inlet ports 336 via annular passage 390. Accordingly, the hydraulic actuation arrangement formed by first and second pressure chambers 380, 382 of rotary actuator 300 advantageously provides the actuating force to rotationally actuate rotary actuator 300 unlike prior designs which require an exterior actuator to provide the actuating force.

While those skilled in the art will immediately discern the method of operating the embodiments of the rotary actuator described herein from the structural description provided above, the following provides an exemplary embodiment of a method of operating the rotary actuator. The following description utilizes rotary actuator 100 for purposes of explanation, although it will be recognized that the method described in the following applies equally well to rotary actuators 200, 300.

Referring back to FIGS. 1-6, to rotate rotor assembly 122 in a desired rotational direction 110, 112, hydraulic supply 108 provides fluid at a first pressure to first inlet 126, and fluid at a second pressure to 128. These first and second fluid pressures are communicated to the first and second pressure chambers as described above. Because the pressures are not equal, a force imbalance acts upon rotor vanes 172 causing the desired rotation of rotor assembly 122 about longitudinal axis 118. Sensor 160 detects this rotation and feeds this information back through an appropriate feedback and control loop to thereafter continue to modulate the first and second pressures of the fluid provided to first and second inlets 126, 128.

As described herein, embodiments of the rotary actuator according to the invention overcome existing problems in the art with torque-tube style rotary actuators by entirely eliminating the need for an external actuator to provide a force to rotate the actuator. Instead, this actuation force is provided by way of the inventive hydraulic actuation arrangement formed between the stator and rotor assemblies.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A rotary actuator for actuating the variable stator vanes of a compressor section of a turbine engine, the rotary actuator comprising:

a stator assembly centered along a longitudinal axis of the rotary actuator;

a rotor assembly surrounding the stator assembly; the rotor assembly rotatable about the longitudinal axis relative to the stator assembly;

first and second bearing assemblies mounted at adjacent opposed axial ends of the stator assembly and connected between the stator assembly and rotor assembly to allow for the rotation of the rotor assembly about the longitudinal axis relative to the stator assembly; and a hydraulic actuation arrangement formed between the rotor assembly and the stator assembly, the hydraulic actuation arrangement including at least one first pressure chamber and at least one second pressure chamber, an at least one rotor vane of the rotor assembly located between the at least one first pressure chamber and the at least one second pressure chamber, the at least one first pressure chamber operable to receive a hydraulic fluid at a first pressure, the at least one second pressure chamber operable to receive a hydraulic fluid at a second pressure different than the first to create a pressure differential between the at least one first and second pressure chambers operable to rotate the at least one rotor vane and the rotor assembly about the longitudinal axis;

further comprising an inlet manifold, the inlet manifold having a first inlet and a second inlet, and wherein the stator assembly includes an internal cavity defining a first inlet chamber and a second inlet chamber, the first inlet chamber in fluid communication with the first inlet, the second inlet chamber in fluid communication with the second inlet.

2. The rotary actuator of claim 1, further comprising an inlet tube extending from the first inlet and fluidly sealing the first inlet chamber from the second inlet chamber.

3. The rotary actuator of claim 2, wherein the first inlet chamber includes at least one inlet port fluidly communicating the first inlet with the least one first pressure chamber, and wherein the second inlet chamber includes at least one inlet port fluidly communicating the second inlet with the at least one second pressure chamber.

4. The rotary actuator of claim 1, wherein the hydraulic actuation arrangement includes at least one stator vane extending radially outward from a center of the stator assembly, and the at least one rotor vane extending radially inward from an interior hollow surface of an outer housing of the rotor assembly, the at least one stator vane sealingly engaging the interior surface of the rotor housing, the at least one rotor vane sealingly engaging an exterior surface of the stator assembly.

5. The rotary actuator of claim 4, wherein the at least one first pressure chamber is formed on a first side of the at least one stator vane, and wherein the at least one second pressure chamber is formed on a second side of the at least one stator vane.

6. The rotary actuator of claim 1, further comprising at least one connection element formed on an exterior of the rotor assembly, the at least one connection element configured to connect the rotor assembly to a unison ring of the compressor section of the turbine engine.

7. The rotary actuator of claim 1, wherein at least one of the at least one first pressure chamber and the at least on second pressure chamber has a variable volume.

8. A rotary actuator for actuating the variable stator vanes of a compressor section of a turbine engine, the rotary actuator comprising:

a stator assembly centered along a longitudinal axis of the rotary actuator;

a rotor assembly surrounding the stator assembly; the rotor assembly rotatable about the longitudinal axis relative to the stator assembly;

first and second bearing assemblies mounted at adjacent opposed axial ends of the stator assembly and connected between the stator assembly and rotor assembly to allow for the rotation of the rotor assembly about the longitudinal axis relative to the stator assembly; and a hydraulic actuation arrangement formed between the rotor assembly and the stator assembly, the hydraulic actuation arrangement including at least one first pressure chamber and at least one second pressure chamber, an at least one rotor vane of the rotor assembly located between the at least one first pressure chamber and the at least one second pressure chamber wherein at least one of the at least one first pressure chamber and the at least one second pressure chamber has a variable volume; and an inlet manifold, the inlet manifold having a first inlet and a second inlet, and wherein the stator assembly includes an internal cavity defining a first inlet chamber and a second inlet chamber, the first inlet chamber in fluid communication with the first inlet, the second inlet chamber in fluid communication with the second inlet.

9. The rotary actuator of claim 8, wherein the hydraulic actuation arrangement includes at least one stator vane extending radially outward from a center of the stator assembly, and the at least one rotor vane extending radially inward from an interior hollow surface of an outer housing of the rotor assembly, the at least one stator vane sealingly engaging the interior surface of the rotor housing, the at least one rotor vane sealingly engaging an exterior surface of the stator assembly.

10. The rotary actuator of claim 9, wherein the at least one first pressure chamber is formed on a first side of the at least one stator vane, and wherein the at least one second pressure chamber is formed on a second side of the at least one stator vane.

11. A method of actuating the unison rings of a compressor section of a turbine engine using a rotary actuator, the method comprising the steps of:

providing a hydraulic actuation arrangement formed between a rotor assembly and a stator assembly, the hydraulic actuation arrangement including at least one first pressure chamber and at least one second pressure chamber, an at least one rotor vane of the rotor assembly located between the at least one first pressure chamber and the at least one second pressure chamber;

providing an inlet manifold, the inlet manifold having a first inlet and a second inlet, and wherein the stator assembly includes an internal cavity defining a first inlet chamber and a second inlet chamber, the first inlet chamber in fluid communication with the first inlet, the second inlet chamber in fluid communication with the second inlet;

supplying fluid at a first pressure to the at least one first pressure chamber of the hydraulic actuation arrangement of the rotary actuator;

supplying fluid at a second pressure to the at least one second pressure chamber of the hydraulic actuation arrangement of the rotary actuator; and wherein the steps of supplying the fluid at first and second pressures creates a force imbalance acting upon the hydraulic actuation arrangement to rotate the at least one rotor blade of the rotator assembly and the rotor assembly of the hydraulic actuation arrangement relative to the stator assembly about a longitudinal axis of the rotary actuator.

* * * * *